US008024984B2

(12) United States Patent
Paul et al.

(10) Patent No.: US 8,024,984 B2
(45) Date of Patent: Sep. 27, 2011

(54) DEVICE AND METHOD FOR TESTING DECOKING TOOLS

(75) Inventors: Wolfgang Paul, Hamburg (DE); Kay Simon, Iserlohn (DE); Andreas Wupper, Witten (DE)

(73) Assignee: Ruhrpumpen GmbH, Witten (DE)

( * ) Notice: Subject to any disclaimer, the term of this patent is extended or adjusted under 35 U.S.C. 154(b) by 381 days.

(21) Appl. No.: 12/242,182

(22) Filed: Sep. 30, 2008

(65) Prior Publication Data

US 2010/0077876 A1 Apr. 1, 2010

(51) Int. Cl.

| | |
|---|---|
| ***G01N 19/00*** | (2006.01) |
| ***G01F 25/00*** | (2006.01) |
| ***G01F 1/42*** | (2006.01) |
| ***G01P 21/00*** | (2006.01) |

(52) U.S. Cl. ..... 73/865.9; 73/1.26; 73/861.61

(58) Field of Classification Search ..... 73/1.05, 73/1.26, 1.16, 861.39, 865.6, 7, 147, 148, 73/152.01, 152.18, 602, 861.62, 862.323, 73/865.9; 15/193.2

See application file for complete search history.

(56) References Cited

U.S. PATENT DOCUMENTS

| | | | | |
|---|---|---|---|---|
| 2,382,999 | A * | 8/1945 | Lee | 73/148 |
| 2,593,491 | A * | 4/1952 | Saunders et al. | 73/147 |
| 6,926,013 | B2 * | 8/2005 | Martin et al. | 134/22.18 |
| 7,819,009 | B2 * | 10/2010 | Borah et al. | 73/602 |

* cited by examiner

*Primary Examiner* — Lisa Caputo
*Assistant Examiner* — Roger Hernandez-Prewitt
(74) *Attorney, Agent, or Firm* — Luedeka, Neely & Graham, P.C.

(57) ABSTRACT

A device for testing decoking tools comprises means 30 for receiving the decoking tool 31 which can be connected to a high-pressure water conduit, as well as means for testing the water jet which exits from a nozzle of the decoking tool 31 following the opening of the high-pressure water conduit. It is possible to test, measure and analyse the high-pressure water jet exiting from the nozzle by means of this testing device in order to optimize the performance of the decoking tool on the basis of the results of this examination. According to the method of the invention the high-pressure water jet generated by means of the nozzles of the decoking tool is exposed to means for testing the high-pressure water jet.

12 Claims, 4 Drawing Sheets

DEVICE AND METHOD FOR TESTING DECOKING TOOLS

BACKGROUND OF THE INVENTION

The invention concerns a device and a method for the testing of decoking tools.

As is well known, decoking tools are used in refineries in context with the emptying of coke drums, in which refineries coke remains at the end of processing crude oil, the coke being collected in coke drums of e.g. 30 m of height and a diameter of 8 m. Once the coke drums are full they are emptied within the shortest possible period of time so that they will be available again as soon as possible for receiving newly accruing coke.

For the emptying of coke drums, so called decoking tools are employed which are provided with boring nozzles and cutting nozzles. Such a tool is mounted on the lower end of a hollow drill stem which is guided on a frame above the boring drum so as to be lifted and lowered and which is supplied with pressurized water via high-performance pumps. On emptying the coke drums the decoking tool is guided through the coke drum, initially starting at the top and moving towards the bottom for boring-up a central vertical channel by means of the now rotating drill stem, wherein water jets exit from the boring nozzles arranged on the underface of the decoking tool at high-pressure, crushing the coke and pushing it away so that the required central bore can be formed in the coke drum. Having arrived at the bottom, the decoking tool is switched from boring to cutting, so that the water jets are no longer discharged from the boring nozzles but from two cutting nozzles diametrically opposing each other on the circumference of the decoking tool. The decoking tool is now lifted, again whilst rotating, by the drill stem. Herein, the water jets exiting from the cutting nozzles break the coke over the whole cross-section of the drum up to the drum wall, so that the coke may fall downwardly in the drum and may be delivered from an opening at the lower end of the drum.

The cutting performance of the decoking tools depends on parameters such as the pressure of the water in the nozzles (e.g. approximately 350 bar), the diameter of the nozzles, the type and temperature (e.g. 300-700° C.) of the coke and other factors.

In the development of decoking tools up to date, testing of function can only be carried out on components or component assemblies of the tools such as valve controls, flow channels etc. and this is done under testing conditions with conditions and demands reduced in relation to practice. In the development of novel nozzle geometries for improving the cutting performance one is also restricted to model calculation and to tests which are supported by assumptions concerning the profile of the pressurized water jet in practice. It is rather unsatisfactory when the development results may only be tested theoretically or by means of testing equipment not allowing safe conclusions regarding the factual function during operation in practice. As a result, enhancements such as the geometry of cutting nozzles and boring nozzles, whose effects on the cutting performance very essentially depend on the water pressure present immediately within the nozzle, can only be judged reliably in practical operation in the coke drum. Even there, the options for distinguished perceptions are limited because the function of the decoking tool can only be tested very roughly due to the conditions within the coke drum.

SUMMARY OF THE INVENTION

It is therefore the object of the invention to provide a testing device or equipment for decoking tools under conditions which are very similar to the operation of the decoking tools in practice.

For solving this object means for receiving a decoking tool are provided, the decoking-tool can be connected to a high-pressure water conduit and means for testing of at least one water jet can be provided, which jet exits from a nozzle of the decoking tool upon opening the high-pressure water conduit.

For the first time, this testing device according to the invention allows for the testing of a high-pressure water jet exiting from a nozzle of a decoking tool under conditions which largely correspond to those in practice. In other words, a complete decoking tool appropriate for cutting or boring coke is used. Means for receiving the decoking tool in the testing device are provided. The decoking tool can be connected to a high-pressure water conduit at a water pressure of appr. 350-380 bar which is common in practice, so that the high-pressure jet corresponds to the water jet with which coke is crushed when coke drums are being emptied.

The means for testing primarily relate to the jet pressure, in which connection the generated free pressurized water jet can be tested and examined at any distance from the nozzle opening in order to develop the requirements for an expedient jet geometry for optimal cutting conditions. The effects of different nozzle geometry may now be examined under conditions of practice as well as under different pressures of operation, and they can be enhanced correspondingly, e.g. in order to avoid undesirable turbulences within the water jet which would be performance-reducing.

Theoretically, a testing device for decoking tools according to the invention may be operated out of doors or in closed areas of halls or the like, provided sufficient safety measures have been taken by screening against the extremely destructive force of the water jet which has to be used according to the definition of purposes. Herein, it has to be taken into account that a pressurized water jet, discharged from a nozzle of a decoking tool at a pressure of approximately 350 bar in the pressurized water conduit, can develop a velocity of 250 m/sec when exiting from the nozzle. As a consequence, the expenditure for safety measures as well as for screening the environment against impairment due to splash water or the like is fairly high even if the object of testing under conditions of practice may well be reached under these circumstances.

The invention also includes a method for testing decoking tools according to which a decoking tool is connected to a high-pressure water conduit and generates a high-pressure water jet by means of nozzles of the decoking tool and this high-pressure water jet is subjected to means for testing the high-pressure water jet.

For reducing the expenditure and in particular for reasons of safety an embodiment of the invention is characterised by a jet housing into which the water jet exiting from the nozzle of the decoking tool enters and which has at least one of the means for testing or is prepared for receiving one such means for testing. Collecting a pressurized water jet in a jet housing will combine sufficient protection of the environment and the desired options to examine the pressurized water jet in order to influence its generation and geometry by changing the conditions of exiting. Optical means for testing the jet may as well be disposed in the jet housing as may be sensors for testing the pressure etc.

It is preferred that the means for receiving the decoking tool be arranged spatially associated to the jet housing, which association is either fixed or may be changed selectively. Thus, it is possible to arrange decoking tool reception means displaceable with respect to the jet housing in order to be able to test certain parameters of the water jet under pre-determined, changed conditions. However, it is preferred to provide a fixed association in context with measuring and testing devices which can be applied remotely as well under changed conditions.

According to a further development it is provided that the means for receiving the decoking tool are arranged in the jet housing to be accessible from the outside or to project there from at least partially. If the reception means are in the jet housing, a corresponding passage of the high-pressure water conduit through the wall of the jet housing or from the end of the jet housing has to be provided. As will yet become apparent from another example of embodiment, however, partially projecting means for receiving the decoking tool, namely means projecting at the top and at the bottom, have to be provided expediently for the sake of place requirement and of saving material.

In order to be able to receive the decoking tool safely and to have it separated safely from the environment, it is preferred that the means for receiving the decoking tool include a reception housing which is fixedly connected to the jet housing or is adapted to be connected thereto in a detachable manner. In this way, the wall of the reception housing may pass into the wall of the jet housing so that the testing device is closed with respect to the environment at least in this area apart from the necessary connections or ports.

It is advantageous that the decoking tool, together with the means for receiving the decoking tool be arranged relative to the jet housing such and be adapted to be controlled such that when the decoking tool is set to the cutting function, a water jet either exits from only one of the cutting nozzles of the decoking tool and enters the jet housing, or that of the water jets exiting from both cutting nozzles only one jet enters the jet housing for testing while the other one is lead away via a short path. The last mentioned alternative is preferred because, in this manner, a passage flow of the pressurized water through the decoking tool will result, which corresponds to practice. In each case, one pressurized water jet entering the jet housing and passing the jet housing is obtained, which allows for all options for examining and testing without still requiring examination of the second jet. Moreover, the length of the jet housing may thus be limited to an economic degree without such sections of the jet having to remain untested as could be important with respect to practice, at least when taking the length of the jet into consideration. This is an aspect essential for the expenditure of the testing device, Restricting the length of the jet housing to the length of the jet essential for practice in the aforementioned manner expediently leads to the means for receiving the decoking tool being arranged in the region of one end of the jet housing or at least at a shorter distance from this end than from the other end. For leading away the second jet only a short housing section is required.

It is preferred that a section of the jet housing extending from the means for receiving the decoking tool in a rectilinear direction passes into an arcuate section at its end. The arcuate section effects a gradual deflection of the jet to conduits via which the water is lead away.

Advantageously, a sealingly closable opening for inserting sensors and other parts of testing and measuring devices into the jet housing is arranged in the jet housing at the end thereof opposing the decoking tool. In this manner, revealing testing and measuring results may be obtained depending on which testing and measuring devices are inserted into the jet housing through the opening arranged at the end of the jet housing such that the jet may impinge thereon. Thus the differences e.g. regarding the measured values of the pressure within the cross sectional face of the jet may be detected and evaluated. Moreover, the sensors and the like may be arranged at different distances from the opening of the nozzle in order to be able to detect the profile of the jet along the axis of the jet housing as exactly as possible forming the basis for changes with which improvements of the jet may be obtained. Instead of sensors and the like, however, coke parts mounted in corresponding holders may be inserted into the jet housing through the opening in order to detect the pattern of destruction caused by the impact of the jet, and to change the same, if necessary. Additionally, or as a replacement for this opening, of course, further sealingly closable openings of this type are possible at other locations of the jet housing.

When the opening for inserting testing and measuring means lies in the arcuate section of the jet housing, the testing and measuring means may be arranged in the region of the axis of the jet housing. Furthermore the outer wall of the arcuate section is suited for applying a corresponding opening for inserting testing and measuring means.

In this manner, the testing and measuring means may be arranged in the region of the axis of the jet housing before the jet is deflected following the arcuate section. Moreover, the outer wall of the arcuate section is suited for arranging a corresponding opening for inserting testing and measuring means.

An essential additional inventive measure lies in that the jet housing has inspection windows on at least one side. Inspection windows for monitoring the pressurized water jet and other features in the area of formation and course of the jet are expedient in all regions, i.e. also where the reception housing for the decoking tool is arranged. The jet housing should be provided with inspection windows, possibly over its total length and in particular on those of the sides opposing each other, in order to be able to check and examine any jet section optically and to monitor the resulting conditions for example in case of reduction of the length of the jet following the insertion of baffle means, as well. For reasons of security, and, if possible, multi-layered or laminated safety glass or bullet-proof glass should be used for the inspection windows. Monitoring may also be performed through the monitoring windows with laser and IR cameras etc. at a safe distance from the jet housing.

The pressurized water conduit should be connected to a high-performance pump, if possible, whose intake duct is lead to a receptacle which is associated with a return line for the water under pressure exiting from the nozzles of the decoking tool. In this manner water is guided in circulation within the testing device.

Furthermore, it is expedient that the means for receiving the decoking tool be arranged such that the water jet exits essentially in a horizontal direction from the cutting nozzles of the decoking tool. On the one hand, this direction of exiting corresponds to the practice of the cutting operation within coke drums, and, on the other hand, a horizontal water jet, namely a water jet in a jet housing correspondingly extending in an essentially horizontal direction may be monitored more easily. Also, handling and inserting of measuring and testing means can be performed more easily.

It is preferred that means for the testing of water jets exiting from the boring nozzles of the decoking tool be provided as well. In this manner, one is able to obtain valuable findings, which, again, correspond to practice, and measuring values for an optimal configuration of the jet exiting from the boring nozzles.

It is expedient for the testing of the boring nozzle jets that a testing device for testing water jets from the boring nozzles of the decoking tool be provided below the jet housing and the means for receiving the decoking tool. This testing device may be designed such that it detects all parameters for the boring jet profile which can be measured and detected under the given circumstances. Above all, inspection windows for monitoring are expedient in this case as well.

BRIEF DESCRIPTION OF THE DRAWINGS

In the following, an example of embodiment will be explained in greater detail and with reference to the drawings. In the drawings, there is shown in.

DETAILED DESCRIPTION

Figure 1:
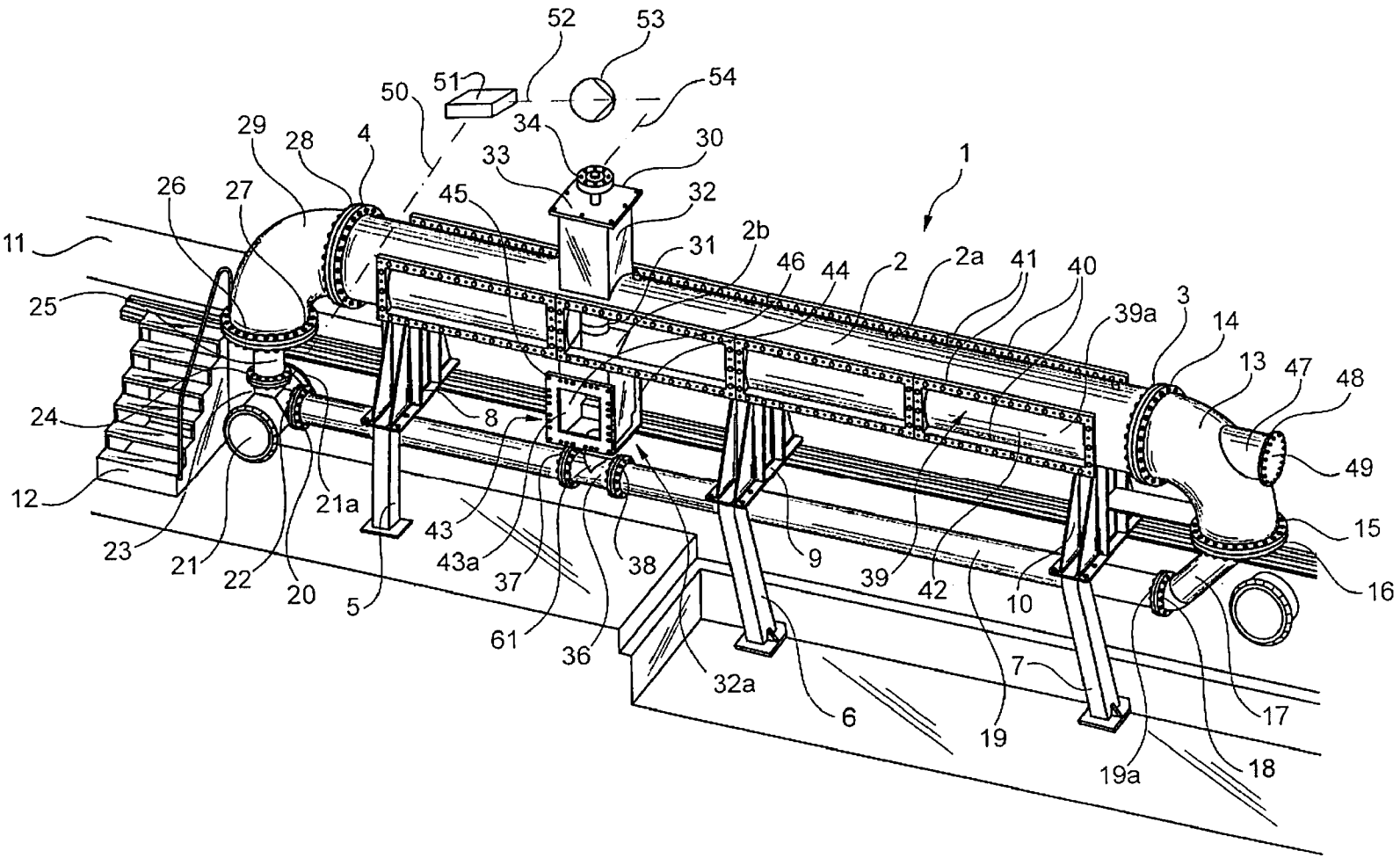
FIG. 1 is a perspective view of a testing device for decoking tools.
Figure 2:
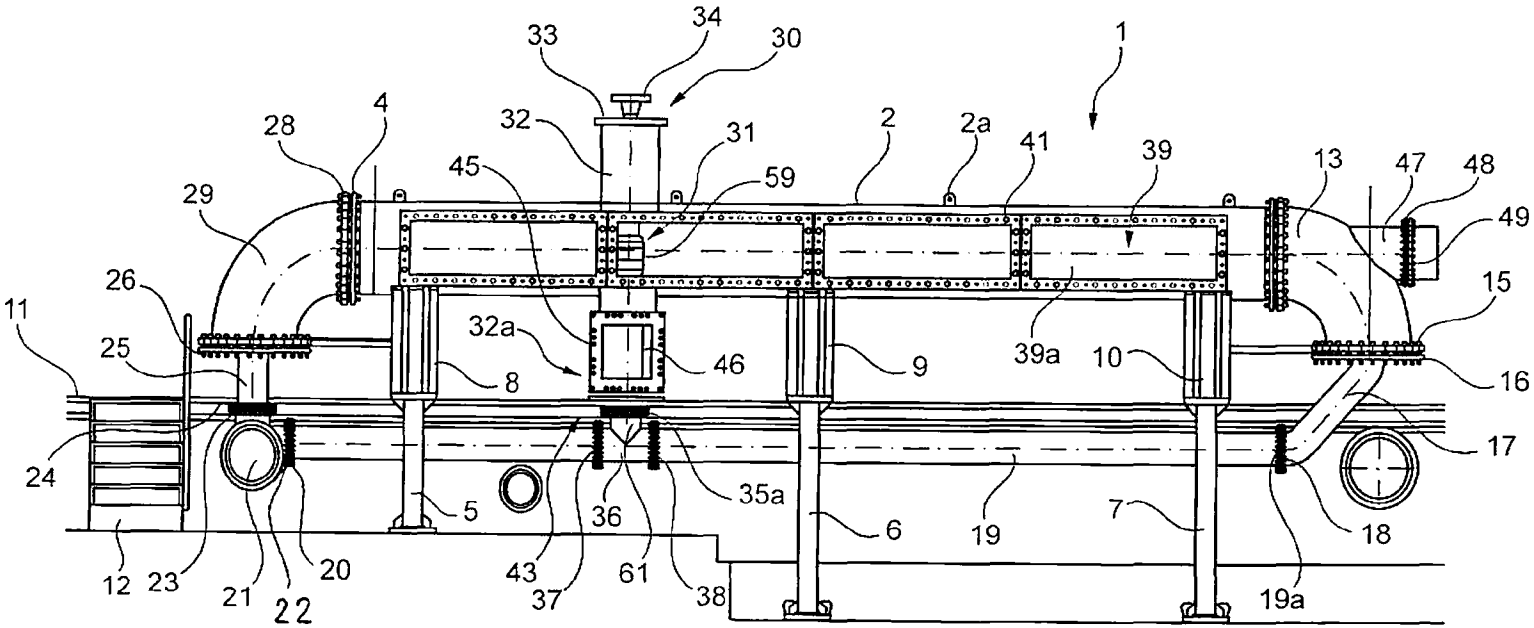
FIGS. 2, 3 and 4 respectively are one side view, one top view, and one front view, each, of the testing device of FIG. 1.
Figure 3:
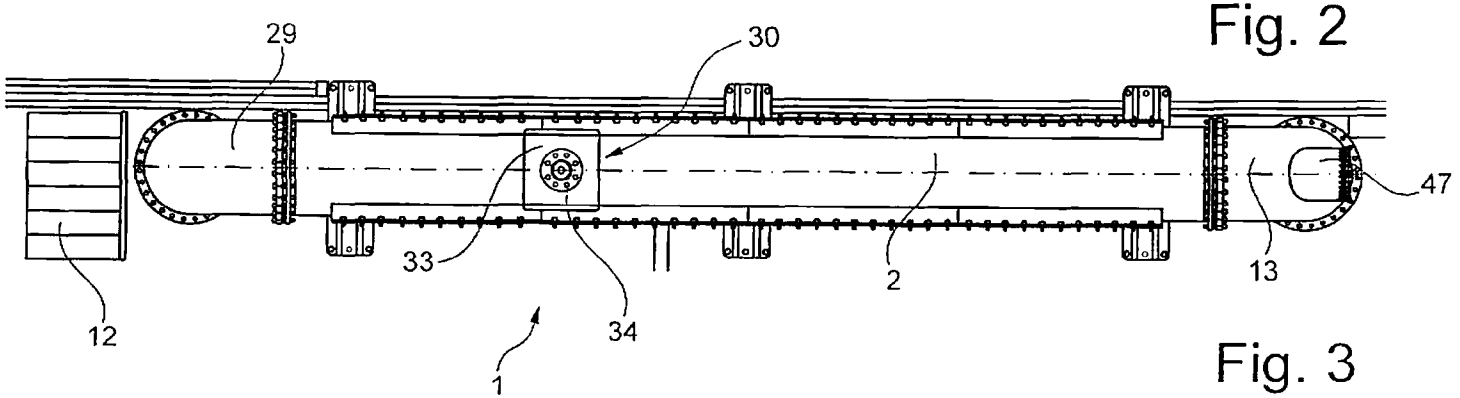

A testing device for decoking tools represented in FIGS. 1-4 has a jet housing 1, which, in its middle section, is composed of a tubular body 2 extending in a rectilinear direction and having eyes 2*a* as well as flanges 3, 4 at its ends. The tubular body 2 of the jet housing 1 rests on brackets 8, 9, 10, as shown in the drawing, which brackets, in the front, bear on supports 5, 6, 7, and, in the rear—when taking the drawing—, on an accessible platform 11 which can be reached via stairs 12. This structure takes into account the particular structural circumstances of this example of embodiment. At its one end, the tubular body 2 passes into an arcuate section 13, connected via flanges 3, 14, which arcuate section has a stub 47 with an opening 48 and arranged approximately within the axis of the tubular body 2, the opening 48 being closable by means of a lid 49 which can be attached detachably by means of bolts.

Below the arcuate section 13 of the conduit the latter continues by a connecting tube 17 and. via flanges 18, 19*a*. by a collecting tube 19 extending approximately parallel to the tubular body 2 and below the same. In the collecting tube 19, an intermediate tubular piece 36 has been inserted by means of flange connectors 37. 38. At its end, the collecting tube 19 passes into a T-shaped tubular piece 21 and is connected to this T-shaped tubular piece 21 by flanges 20, 22.

An arcuate tubular section 29 is connected at the other end of the tubular body 2 via flanges 4, 28, at the lower end of which tubular section 29 there is connected a flange 27 having a flange plate 26 of an intermediate tubular piece 25. The lower flange 24 of this intermediate tubular piece 25 is connected to a tubular connector piece 23 having a flange, which piece 23 passes into said T-shaped tubular piece 21 which, at its one end, is connected to a conduit 50 schematically indicated in the drawing by means of a flange 21*a*, whereas the other end of the T-shaped tubular piece 21 is closed and may be used for other conduit connectors. Furthermore, a water receptacle 51 connected to the conduit 50, a further conduit 52 leading to a high-pressure water pump 53, and a conduit 54 leading to a port 34, which yet has to be explained, are also indicated only schematically in the drawing.

Rectangular openings 39*a* extend on both sides of the tubular body 2, which openings are enclosed by correspondingly rectangular fittings 40 on which window frames 41 having security glass glazing 42 have been fitted in a sealing manner, in order to form inspection windows 39. In this manner the inside of the tubular body 2 may be monitored over the whole length thereof from both sides of the jet housing 1.

At the top of the tubular body 2, there are means 30 for receiving a decoking tool 31 and including a reception housing 32, which means 30 are placed with a clearly larger distance of the reception housing 32 from the right end of the tubular body 2 when compared with the left end thereof. The upper opening of the reception housing 32 is closed by means of a cover 33 which is screwed to the reception housing 32 in a sealing manner and has the aforementioned port 34 for a high-pressure water conduit. An opening 2*b* is arranged on the lower side of the tubular body 2 and opposing the reception housing 32.

Figure 4:
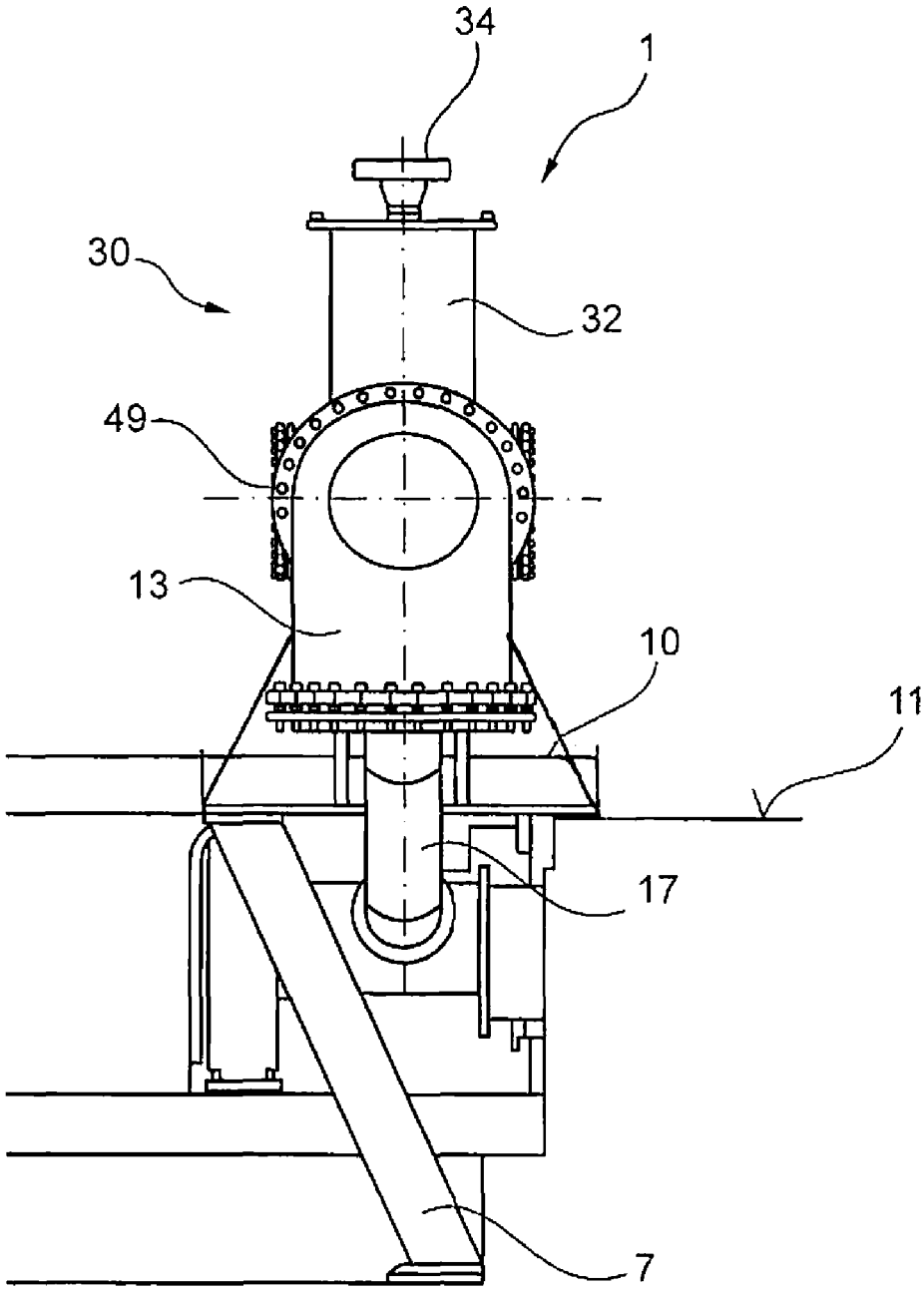

For the purpose of testing, a decoking tool 31 having boring nozzles and cutting nozzles 58, 59, respectively, is mounted within the reception housing 32 in a manner as can be taken from FIG. 4 and connected to the port 34 via a flange connection 55, an intermediate tubular piece 56, a further flange connection 57*a*, and a tubular passage 58*a*.

Opposing the reception housing 32 on the tubular body 2, there is a chamber 32*a* arranged on the lower side of the tubular body 2. As shown in the drawing, it has inspection windows 43 on opposing sides of the chamber 32*a* with openings 43*a* in the chamber wall and fittings 44 for sealingly bolting frames 45 having glazing 46 of security glass, so that the inside of the chamber 32*a* and at least the lower portion of the decoking tool 31 can be monitored through the inspection windows 43 and the respective function of the decoking tool 31—cutting or boring—may be detected. Deflection plates 57 protect the inspection windows 43 from direct impact of water jets from the boring nozzles 58.

In order to carry away water, there is an opening 60 on the bottom side of the chamber 32*a*, to which opening is connected a tubular piece 35 with a flange 35*a* for attachment with a further tubular piece 61 to the intermediate tubular piece 36 with flange connectors 37, 38 for inserting the intermediate tubular piece 36 into the connecting tube 19.

Figure 5:
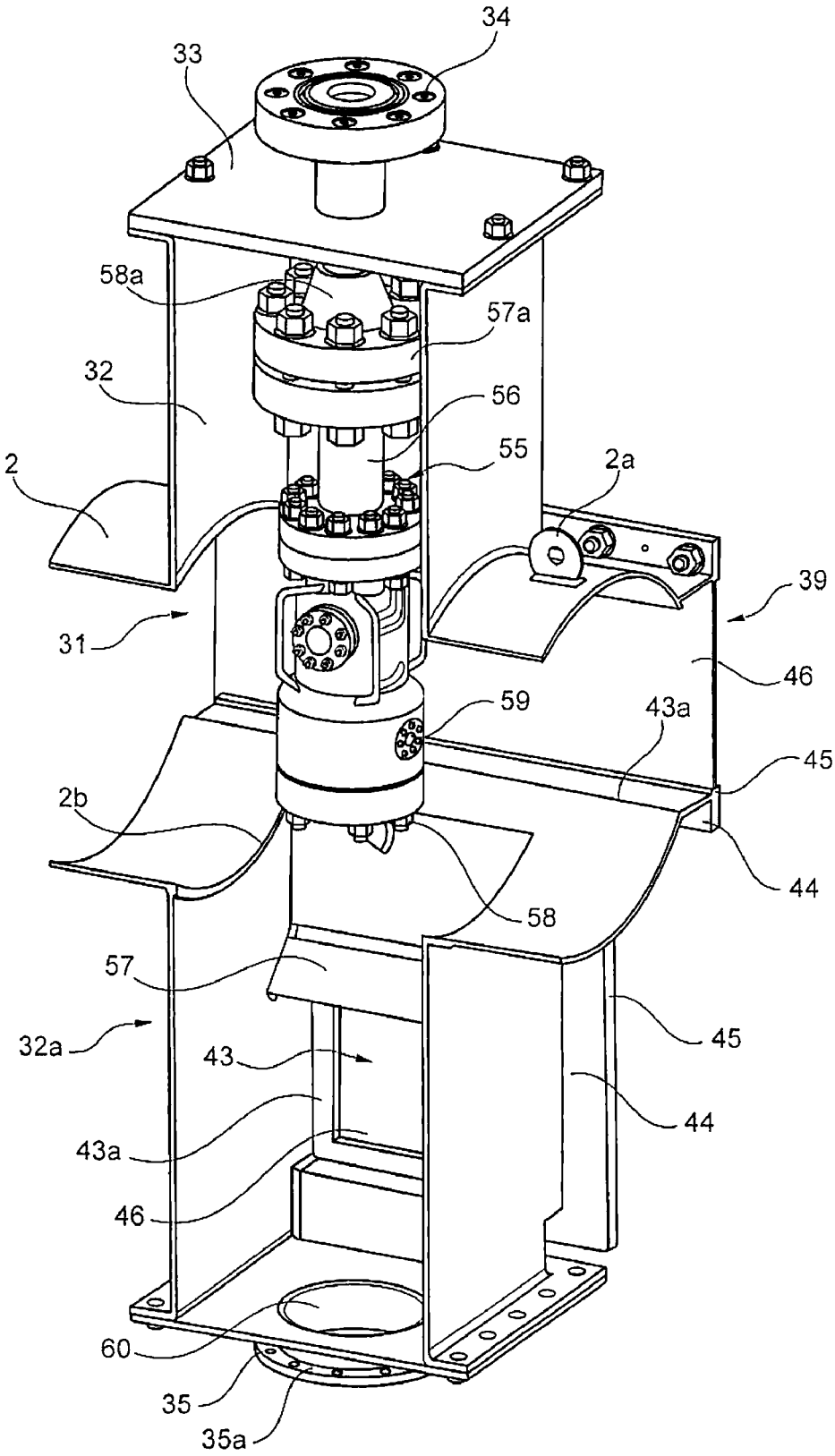
FIG. 5 is a perspective sectional representation of the testing device of FIGS. 1-4 in the region of means for receiving a decoking tool.

For testing a decoking tool 31 this will be inserted into the reception housing 32 in a manner as can be taken from the drawing (FIG. 5) and connected to the port 34 in a pressure-tight manner. Herein, the arrangement of the decoking tool 31 is performed such that the cutting nozzles 59 are aligned essentially in the direction of the central axis of the tubular body 32 and that the boring nozzles 58 are aligned such that a water jet exiting from the boring nozzles will pass the opening 2*b* of the tubular body 2.

As soon as the non-shown motor of the high-performance water pump 53 has been switched on and the high-performance motor pump 53 will supply pressurized water to the decoking tool 31 via the conduit 54 and the port 34, a high pressure water jet will be discharged—if the function "cutting" has been set on the decoking tool 31—from both cutting nozzles 59 arranged to oppose each other on the decoking tool 31, and will pass the corresponding sections of the tubular body 32 up to the deflection through the arcuate tubular sections 13, 29 with a subsequent return via the connection tube 17 and the collecting tube 19, as far as the water jet exiting to the right hand side is concerned, as well as via the intermediate tubular piece 25 with respect to the water jet exiting to the left hand side, with the discharged water being brought together within the T-shaped tubular piece 21, as well as with the subsequent return thereof via the conduit 50 into the water receptacle 51. In this manner, a circulation of the water needed for testing purposes is brought about.

The water jet exiting to the left with respect to the drawing may be inspected through the inspection windows 39 present in this area as well. However, primarily the water jet is made to exit from the respective cutting nozzle 59 so that flow conditions as appearing in practice may be formed within decoking tool 31, which conditions are changed on closing the cutting nozzle 59 on the left. Furthermore, the reaction forces of both water jets will cancel out each other.

The water jet exiting from the cutting nozzle of the decoking tool 31 present on the right of the drawing may develop a length as will be intended in the future and which may be, e.g. in the order of 5-10 m. In the present example of embodiment the length of the tubular body is about 10 m, and the distance of the flange 3 from the middle of the reception housing amounts to 32.7 m, without any restriction being intended by these statements.

The shown testing equipment offers manifold options for checking and testing the decoking tool 31 and, in particular, the high-pressure water jet exiting from the right cutting nozzle 59. The inspection windows 39 allow for an optical testing of the jet at any distance from the cutting nozzle 59 by mere observation or by means of separate IR or laser cameras or the like. It is thus possible to obtain exact information and knowledge about the structure of the jet in any one of its cross sections and at any distance from the cutting nozzle 59, which can be obtained for different high-pressure ranges and stages as well as for any geometry of the nozzles appearing appropriate.

Various testing, checking and measuring devices may be inserted into the tubular body 2 through the opening 48 with correspondingly adapted covers, on which the water jet impinges and which, on their part, may be arranged at any possible and optional distance from the opening of the nozzles. It would be too much to mention, in the present description, all parameters and measuring values which may be used and performed apart from optical tests and pressure and impact measurements. However, hot or heatable pieces of coke may be inserted into the tubular body 2 through the opening 48 in order to detect the pattern of crushing and to change the same, if necessary.

Since the high-pressure water jet which may be obtained with the present testing equipment within the tubular body 2 corresponds to conditions of practice, and since the high pressure water jet may be examined and measured exactly, means for optimizing the water jet and, above all, the cutting performance of high pressure water jets are now at hand which had not been available before.

The testing equipment according to the invention may be configured in various manner, as has already been explained in the initial stages of the specification. However, one needs, in any case, the means 30 for receiving the decoking tool 31 which are presently designed as a reception housing 32. Furthermore, the decoking tool 31 must be connectable to a high-pressure water conduit 54. Moreover, means for the testing of the water jet exiting from the decoking tool must be arranged, i.e. means for testing the jet which exits from a nozzle of the decoking tool 31, in particular from a cutting nozzle 59, on opening the high-pressure water conduit. The tubular body 2 has been selected particularly for four reasons in the present example of embodiment. It enables the formation of a high-pressure water jet as in practice. The water jet may be subjected to testing in manifold manner. The tubular body 2 offers sufficient safety in order to avoid impairments of the environment. And the tubular body 2 may be integrated in a water circulation in a simple manner.

The invention claimed is:

1. Testing equipment for use with a decoking tool, which decoking tool includes at least one nozzle for discharging at least one high-pressure water jet being adapted to perform a decoking action by at least one of a boring and a cutting action in a coke drum and which decoking tool is adapted to be associated with high-pressure water supply means supplying high-pressure water to said at least one nozzle for generating said at least one water jet and releasing it from said nozzle upon opening of said high-pressure water supply means for performing said decoking action by at least one of a boring and a cutting action, wherein said testing equipment comprises:

reception means for receiving said decoking tool;

jet testing means for testing said at least one high-pressure water jet; and jet housing means into which said at least one water jet exiting from said at least one nozzle of said decoking tool enters and which includes at least one of said jet testing means, wherein said reception means include reception housing means detachably connectable to said jet housing means.

2. Testing equipment for a decoking tool, which decoking tool includes at least one nozzle for discharging at least one high-pressure water jet being adapted to perform a decoking action by at least one of a boring and a cutting action in a coke drum and which decoking tool is adapted to be associated with high-pressure water supply means supplying high-pressure water to said at least one nozzle for generating said at least one water jet and releasing it from said nozzle upon opening of said high-pressure water supply means, said testing equipment comprising:

reception means for receiving said decoking tool;

jet testing means for testing said at least one high-pressure water jet; and jet housing means into which said at least one jet exiting from said at least one nozzle of said decoking tool enters and which includes at least one of said jet testing means, wherein said reception means, together with said decoking tool, are arranged in spatial relationship to said jet housing means and adapted to be controlled such that when said decoking tool is set to said cutting function only one water jet exiting from said at least one cutting nozzle of said decoking tool enters said jet housing means for testing, whereas any further one water jet discharged from any further one cutting nozzle is lead away.

3. Testing equipment as claimed in claim 2, wherein said reception means for receiving said decoking tool are arranged in the region of one of the ends of said jet housing means.

4. Testing equipment as claimed in claim 2, wherein said reception means for receiving said decoking tool are arranged at least at a shorter distance from one end than from the other end, of said jet housing means.

5. Testing equipment as claimed in claim 2, wherein a section of said jet housing means extending from said reception means in a rectilinear direction, at its one end passes into an arcuate section.

6. Testing equipment as claimed in claim 2, wherein said jet housing means, at one end thereof opposing said decoking tool, further comprises sealingly closable opening means for inserting at least one of sensor means and other components of testing and measuring apparatus into said jet housing.

7. Testing equipment as claimed in claim 2, wherein at least said jet housing means includes inspection window means on at least one of its sides.

8. Testing equipment as claimed in claim 2, wherein said high-pressure water supply means is connected to pump means including intake duct means, which intake duct means is guided to receptacle means associated with return line means for the water under pressure exiting from said at least one nozzle of said decoking tool.

9. Testing equipment as claimed in claim 2, wherein said reception means are arranged to receive said decoking tool such that the water jet exits essentially in a horizontal direction from said at least one cutting nozzle of said decoking tool.

10. Testing equipment as claimed in claim 2, wherein said decoking tool comprises at least one boring nozzle and wherein said jet testing means are adapted to test water jets exiting from said at least one boring nozzle.

11. Testing equipment as claimed in claim 2, wherein said testing means for testing water jets from said at least one boring nozzle of said decoking tool is provided as a testing apparatus arranged below said jet housing means and below said reception means for receiving said decoking tool.

12. A combination of a decoking tool and test equipment for testing said decoking tool, the combination comprising:

a decoking tool having:

a boring nozzle positioned to discharge a boring water jet; and a cutting nozzle positioned to discharge a cutting water jet; and testing equipment comprising:

a housing for removably receiving the decoking tool;

a water conduit passing through the housing and coupled to the decoking tool for supplying water to said cutting nozzle and boring nozzle to generate the cutting water jet and boring water jet; and inspection windows positioned to permit inspection of the cutting water jet and boring water jet.

* * * * *